United States Patent [19]

Petros

[11] 4,372,625

[45] Feb. 8, 1983

[54] METHOD AND APPARATUS FOR CHECKING MILL ROLL BEARING ASSEMBLY

[75] Inventor: Andrew J. Petros, Oakdale, Pa.

[73] Assignee: Mesta Machine Company, Pittsburgh, Pa.

[21] Appl. No.: 301,372

[22] Filed: Sep. 11, 1981

[51] Int. Cl.[3] ..... F16C 33/08

[52] U.S. Cl. ..... 384/129; 308/1 R; 73/432R; 384/281

[58] Field of Search ..... 308/37, 237 A, DIG. 11, 308/237 R, 1 R, 58; 73/432 V

[56] References Cited

U.S. PATENT DOCUMENTS

| | | | |
|---|---|---|---|
| 3,201,996 | 8/1965 | Silvia | 73/432 R |
| 3,373,300 | 3/1968 | Sullivan | 308/1 R |
| 4,249,993 | 2/1981 | Stegelitz | 308/237 A |
| 4,341,426 | 7/1982 | Clapp | 308/207 R |

*Primary Examiner*—Lenard A. Footland
*Attorney, Agent, or Firm*—Carothers and Carothers

[57] ABSTRACT

In a mill roll bearing assembly, wherein a mill roll neck is coaxially received in a bearing sleeve journaled for rotation therewith in a housed bearing, and which further includes a sleeve retainer secured to the annular outside end of the bearing sleeve, an inspection passage is provided through an upper end portion of the bearing housing, which reveals the then rotatably positioned uppermost end portion of the sleeve end retainer where it annularly mates with the bearing sleeve and a removable closure is provided for the passage. A second inspection passage is also provided through the end of the sleeve retainer near the outer peripheral edge thereof, which reveals a portion of the outside ends of the sleeve and roll neck where they annularly mate. A feeler gauge is then inserted through the passages when aligned, to check whether the roll neck is fully seated in the bearing sleeve.

4 Claims, 1 Drawing Figure

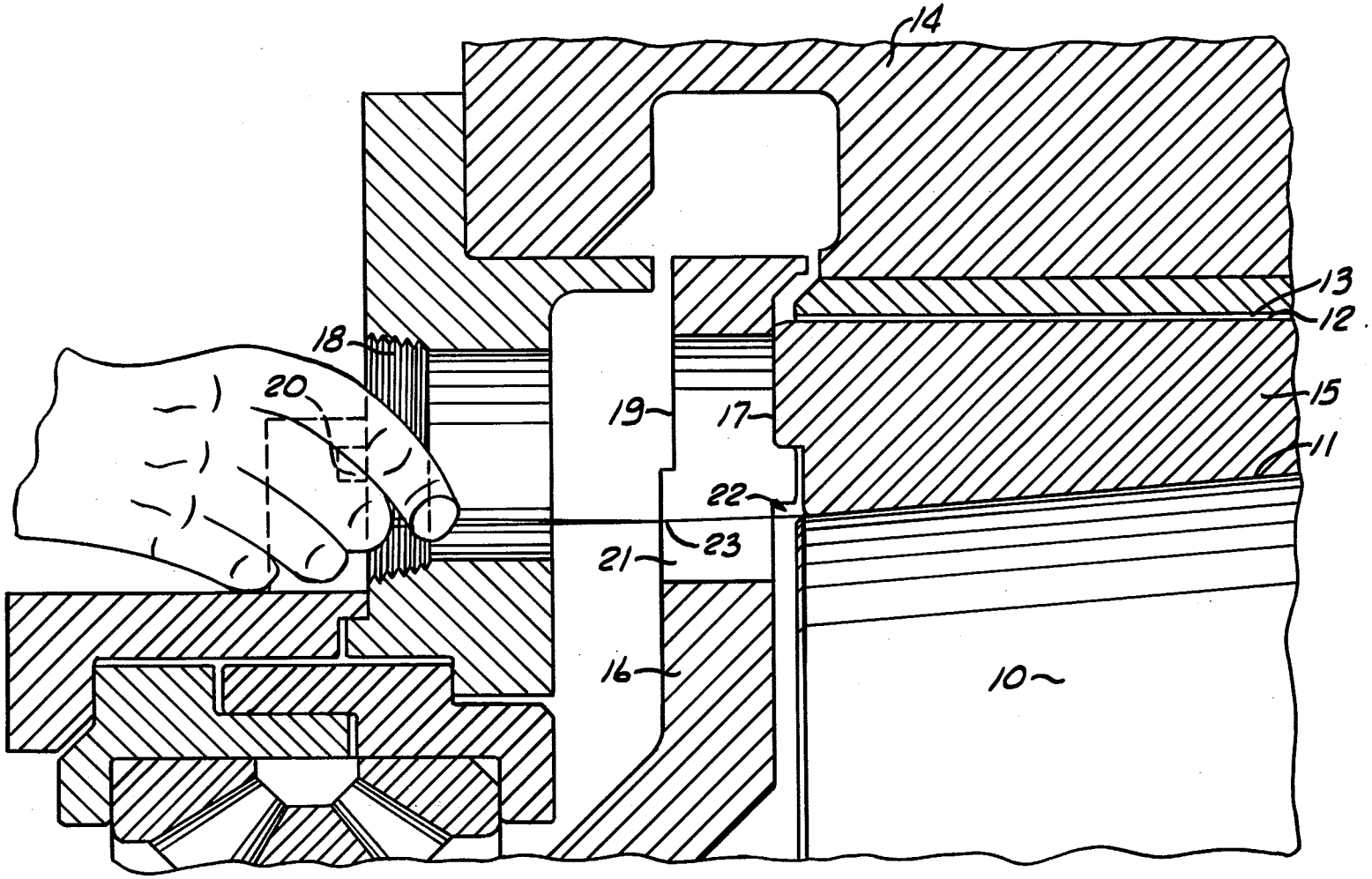
13
12
15
11
14
10
17
22
23
19
21
16
18
20

METHOD AND APPARATUS FOR CHECKING MILL ROLL BEARING ASSEMBLY

The present invention relates to a means for checking whether a roll neck is fully seated in its bearing sleeve in mill roll stands for rolling mills.

In bearings for mill rolls wherein the roll neck is coaxially received in a bearing sleeve journaled for rotation within a bearing chock, and particularly in the type of oil film bearings which utilize a taper journal received within a mating taper bore of a bearing sleeve, there has heretofore been no positive way to check or determine that the roll neck has been fully seated in the bearing sleeve upon assembly of the roll into the bearing.

When scarring has occurred on the internal taper bore of the bearing sleeve, or on the roll taper, undesirable thrust movement is created if the roll taper is not fully seated within the sleeve. This, of course, can damage the mill stand and the strip material being rolled. No effective means has heretofore been provided to determine that the roll neck is fully seated in the bearing sleeve after assembly. It is accordingly a principal object of the present invention to provide such a means for inspection.

In the method and apparatus of the present invention, the roll neck is coaxially received for bearing support within a bearing chock housing and a sleeve end retainer is secured to the annular outside end of the bearing sleeve within the bearing chock housing and annularly covers the outside end of the sleeve where it annularly mates with the outside of the roll neck. An inspection passage is provided through an upper end portion of the bearing chock housing to reveal the then rotatably positioned uppermost end portion of the retainer where it annularly mates the outside end of the bearing sleeve. A removable closure is provided for this inspection passage in the chock housing. Another inspection passage is provided through the end of the sleeve retainer near the outer peripheral edge thereof to reveal a portion of the outside end of the sleeve and roll neck where they annularly mate. The inspection closure in the bearing chock housing is removed and the mill roll together with the bearing sleeve secured for rotation therewith, together with the sleeve retainer, are rotated until the retainer inspection passage is positioned uppermost and is visible through the chock housing inspection passage. A feeler gauge is then inserted through both of the inspection passages and used to feel the fit between the bearing sleeve and the roll neck to determine that the roll neck is fully seated in the bearing sleeve. The invention is of the most important application as relates to tapered bearing fits wherein it is not only important to make certain that the roll neck is fully seated in the bearing sleeve, but additionally, it was heretofore not possible to check the seating after assembly of such tapered fits. If the fit is proper, one will not be able to insert the end of the feeler gauge between the ends of the roll taper journal and the mating bearing sleeve.

Other objects and advantages appear in the following description and claims.

The accompanying drawing shows, for the purpose of exemplification, without limiting the invention or the claims thereto, certain practical embodiments illustrating the principles of this invention wherein the Figure is a vertical sectional view of a portion of a taper journal bearing having the inspection means of the present invention shown.

Referring to the drawing, there is shown one end of mill roll 10 for a rolling mill having a taper journal or tapered roll neck 11. A bearing for the taper journal shown is a taper plain bearing of the prior art, wherein the bearing surface with oil film is provided between bushing 13 housed in bearing housing or bearing chock 14 of a roll stand and a sleeve 15 is closely fitted on the taper journal 11. Generally, the roll 10 has two taper plain bearings, only one of which will be described in detail, since they are symmetrically the same.

The bearing sleeve 15 is keyed (not shown) to the tapered roll neck 11 for rotation therewith, and a sleeve end retainer 16 is annularly secured or bolted to annular outside end 17 of sleeve 15 and annularly covers the outside end 17 of sleeve 15 where it annularly mates with the outside end of roll neck 11 within the housing 14.

An inspection passage 18 is provided through the upper end portion of bearing housing 14 and reveals the then rotatably positioned uppermost end portion 19 of retainer 16 where it annularly mates the outside end of bearing sleeve 15. A removable closure 20, shown in dashed outline and removed, is provided for housing inspection passage 18 and is threadably receivable therein. Another inspection passage 21 is also provided through the end of sleeve retainer 16 near the outer peripheral edge thereof which reveals a portion 22 of the outside ends of sleeve 15 and roll neck 11 where they annularly mate, so that feeler gauge 23 may be inserted through passages 18 and 21 when aligned as illustrated in the Figure, to check as further illustrated, whether or not the roll neck 11 is fully seated in the bearing sleeve 15. A proper fit is maintained if one cannot insert the outer or free end of feeler gauge 23 between the fit when positioned at the uppermost setting as illustrated in the Figure.

I claim:

1. The method of checking that a roll neck of a mill roll is fully seated in its corresponding bearing sleeve for rotation therewith in which the roll neck is coaxially received for bearing support within a bearing chock housing and wherein a sleeve retainer is secured to the annular outside end of said bearing sleeve within said bearing chock housing and annularly covers the outside end of said sleeve where it annularly mates with the outside end of said roll neck, comprising the steps of, providing an inspection passage through an upper end portion of said bearing chock housing to reveal the then rotatably positioned uppermost end portion of said retainer where it annularly mates the outside end of said bearing sleeve, providing a removable closure in said chock housing inspection passage, providing an inspection passage through the end of said retainer near the outer peripheral edge thereof to reveal a portion of the outside ends of said sleeve and roll neck where they annularly mate, removing said inspection closure, rotating said mill roll together with said sleeve and retainer until said retainer inspection passage is positioned uppermost and visible through chock housing inspection passage, inserting a feeler gauge through both of said inspection passages and feeling the fit between said sleeve and said roll neck with said gauge.

2. The method of claim 1, wherein said roll neck is fit in said sleeve with a tapered fit.

3. A mill roll bearing assembly including a mill roll having an end roll neck coaxially received in a bearing sleeve journaled for rotation therewith in a housed bearing and a sleeve retainer secured to the annular outside end of said sleeve and annularly covering the outside end of said sleeve where it annularly mates with the outside end of said roll neck within the housing for said bearing, the improvement comprising, an inspection passage through an upper end portion of said bearing housing which reveals the then rotatably positioned uppermost end portion of said retainer where it annularly mates with the outside end of said bearing sleeve, a removable closure for said housing inspection passage, and an inspection passage through the end of said retainer near the outer peripheral edge thereof which reveals a portion of the outside ends of said sleeve and roll neck where they annularly mate so that a feeler gauge may be inserted through said passages when aligned to check whether the roll neck is fully seated in the bearing sleeve.

4. The mill roll bearing assembly of claim 3, wherein said roll neck is fit in said sleeve with a tapered fit.

* * * * *